US010835085B1

(12) United States Patent
Garcia

(10) Patent No.: US 10,835,085 B1
(45) Date of Patent: Nov. 17, 2020

(54) VOICE-CONTROLLED SHOWER BACK SCRUBBER

(71) Applicant: Yanko Fernandez Garcia, Cutler Bay, FL (US)

(72) Inventor: Yanko Fernandez Garcia, Cutler Bay, FL (US)

( * ) Notice: Subject to any disclaimer, the term of this patent is extended or adjusted under 35 U.S.C. 154(b) by 0 days.

(21) Appl. No.: 16/543,539

(22) Filed: Aug. 17, 2019

(51) Int. Cl.
*A47K 7/04* (2006.01)
*A47K 5/12* (2006.01)

(52) U.S. Cl.
CPC ..... *A47K 7/04* (2013.01); *A47K 5/1217* (2013.01)

(58) Field of Classification Search
CPC ..... A47K 7/04; A47K 5/1217
USPC ..... 15/21.1
See application file for complete search history.

(56) References Cited

U.S. PATENT DOCUMENTS 4,071,021 A * 1/1978 Gallacci ..... A61H 37/00 15/21.1
5,239,712 A * 8/1993 Kinder ..... A47K 7/06 15/21.1
8,272,799 B1 * 9/2012 Yard ..... A46B 13/02 401/6
2003/0167565 A1 * 9/2003 Yoshida ..... A47K 7/04 4/606
2004/0060107 A1 * 4/2004 Eisenberg ..... A61H 9/00 4/605
2009/0241257 A1 * 10/2009 Malta ..... A47K 7/024 4/606
2012/0138087 A1 * 6/2012 Newlin ..... A46B 11/002 134/6
2016/0015224 A1 * 1/2016 Harewood ..... A47K 7/04 15/21.1
2016/0143489 A1 * 5/2016 Grossman ..... A47K 7/04 4/606
2017/0280945 A1 * 10/2017 Verrengia ..... A47K 7/04
2018/0271336 A1 * 9/2018 Mingo ..... A47K 7/024
2019/0159633 A1 * 5/2019 Lee ..... A61G 5/1002

* cited by examiner

*Primary Examiner* — Marc Carlson
(74) *Attorney, Agent, or Firm* — Ruben Alcoba, Esq.

(57) ABSTRACT

A voice-controlled back scrubber that comprises of a rectangular frame that guides a rectangular compartment. The rectangular compartment has a holder that receives a lift belt on its central top inner section. The rectangular compartment houses a liquid soap holder, a plurality of scrubber sprockets that define a spindle, a first servomotor, a plurality of electrical soap dispensers, a plurality of soap dispensing hoses, a second servomotor, a lift belt, a controller and a power source. The rectangular compartment is covered with a cover that has a plurality of apertures that allows the spindles to pass through the cover. Scrubbers attach to the spindles after the cover is placed on the rectangular compartment. And, an accordion cover that attaches to the rectangular frame and to the rectangular compartment so that an inner section of the rectangular frame that covers the holder and the lift belt is covered.

5 Claims, 3 Drawing Sheets

VOICE-CONTROLLED SHOWER BACK SCRUBBER

BACKGROUND

The present invention is a voice-controlled shower back scrubber.

The inventor of the present invention conceived the present invention while showering.

While showering, he realized that his hands could not reach certain parts of his back and that he had to find a solution to the problem.

He searched and found devices that attach to shower walls and that are manipulated to be at certain positions of the shower walls while showering, yet none of the devices were completely automated. Once devices were installed, the user of the devices would have to position their backs into certain positions to accommodate the back scrubbers of the devices.

The present voice-controlled shower back scrubber is designed so that the user can use a voice command to control the movement of the shower back scrubber in relation to his back.

The voice-controlled shower back scrubber of the present invention allows the user to move the shower back scrubber, via a voice command, into a position will correspond to his or her back.

For the foregoing reasons, there is a need for a voice-controlled shower back scrubber that will allow a user to verbally control the position of the shower back scrubber in relation to the user's back when showering.

SUMMARY

The present invention is a voice-controlled shower back scrubber that allows a user to manipulate the position of the shower back scrubber in relation to his or her back.

The voice-controlled back scrubber comprises of a rectangular frame that guides a rectangular compartment. The rectangular compartment has a holder that receives a lift belt on its central top inner section. The rectangular compartment houses a liquid soap holder, a plurality of scrubber sprockets that define a spindle, a first servomotor, a plurality of electrical soap dispensers, a plurality of soap dispensing hoses, a second servomotor, a lift belt, a controller, and a power source. The rectangular compartment is covered with a cover that has a plurality of apertures that allows the spindles to pass through the cover. Scrubbers attach to the spindles after the cover is placed on the rectangular compartment. And, an accordion cover that attaches to the rectangular frame and to the rectangular compartment so that an inner section of the rectangular frame that covers the holder and the lift belt is covered.

The present invention is voice activated so that the rectangular compartment can be moved in either in an upward or a downward direction when it is placed within the rectangular frame.

The present invention can also be moved using a radio frequency device that uses BLUETOOTH technology An object of the present invention is to provide a voice-controlled shower back scrubber that can be manipulated by a user to be at a certain position of a shower wall so that the placement of the shower back scrubber corresponds to an exact location of a user's back that he or she wishes to have scrubbed.

Another object of the present invention is to provide a shower back scrubber that will allow a user to simply stand in one position while having his back scrubbed.

Yet another object of the present invention is to provide a user with a shower back scrubber that will prevent accidents that may occur while showering.

DRAWINGS

These and other features, aspects, and advantages of the present invention will become better understood with regards to the following description, appended claims, and drawings where:

FIG. 3 is a perspective view of the voice-controlled shower back scrubber, wherein its cover and its scrubbers or sponges are on.

DESCRIPTION

Figure 1:
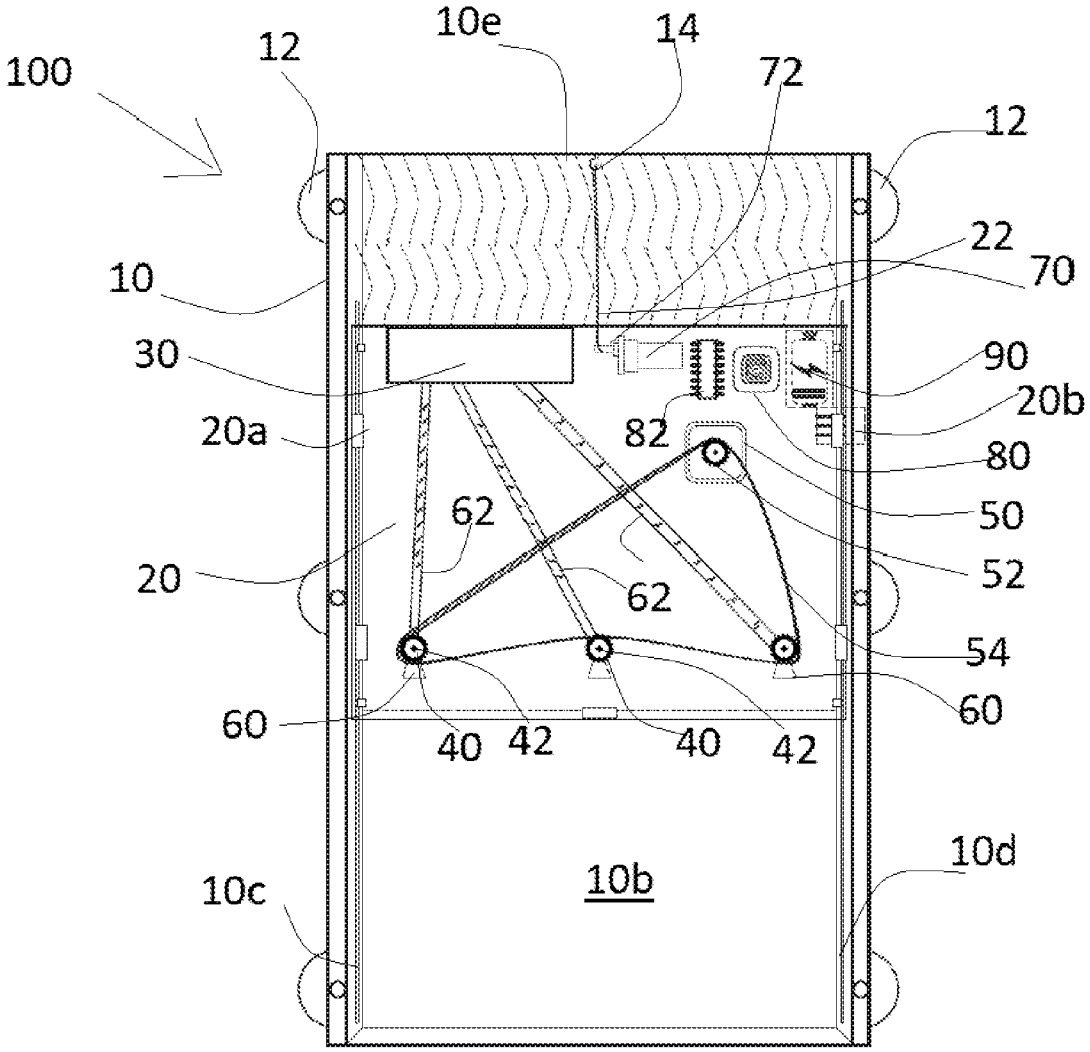
FIG. 1 is a front view of a voice-controlled shower back scrubber of the present invention, in a first position, wherein its front cover is off.
Figure 2:
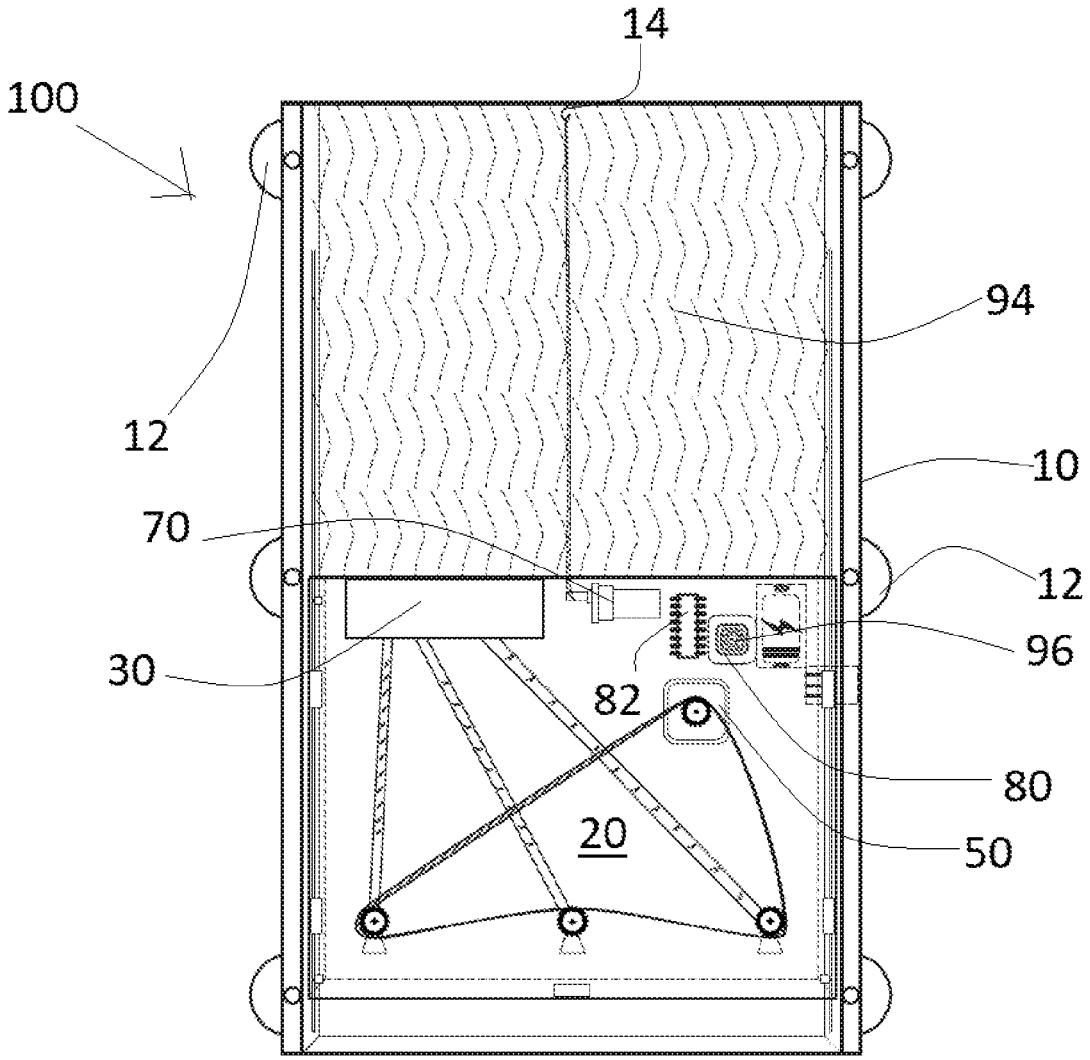
FIG. 2 is a front view of the voice-controlled shower back scrubber, in a second position.
Figure 3:
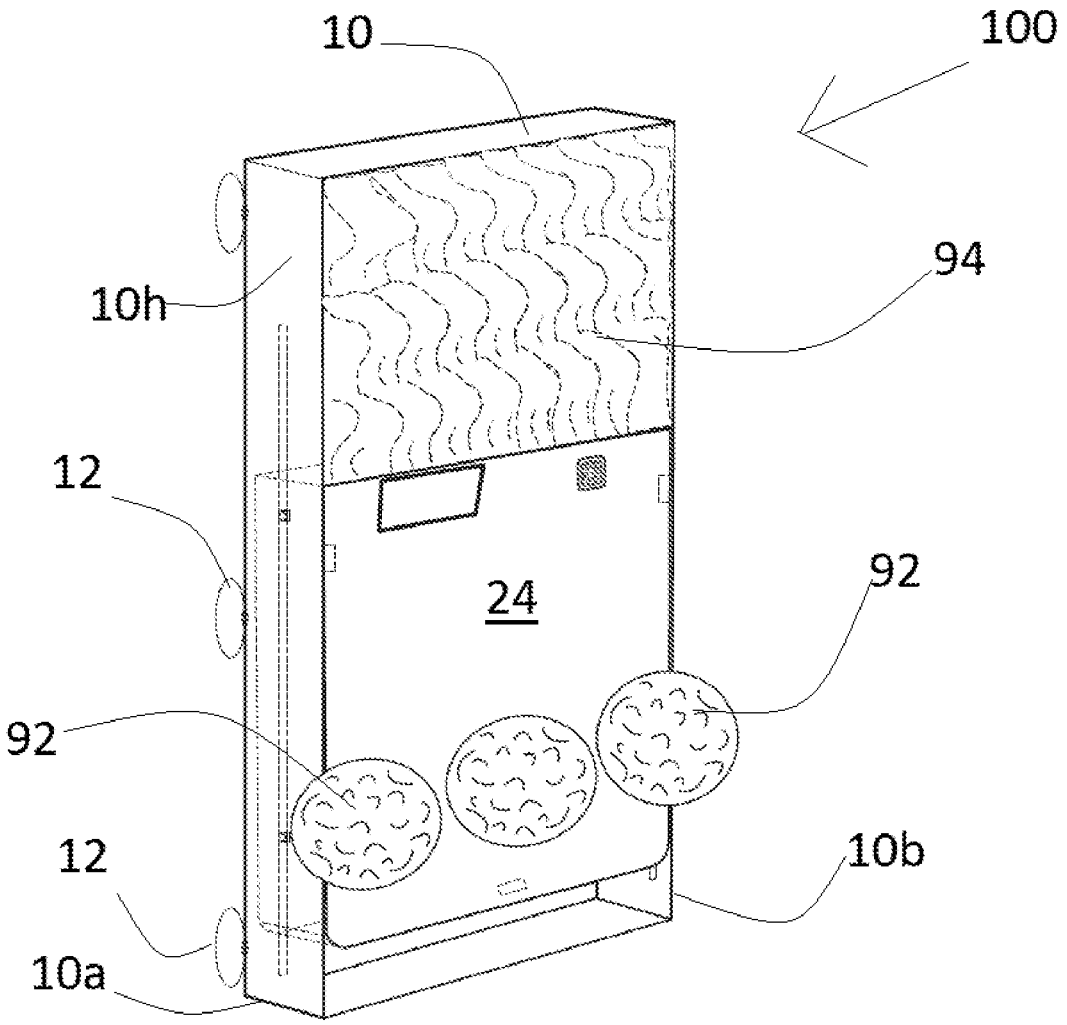

The present invention, referenced in FIGS. 1-3, is directed to a voice-controlled shower back scrubber 100. The voice-controlled shower back scrubber 100 comprises a rectangular frame 10 that has a rear 10*a* and a front side 10*b*, the rear side 10*b* has at least two wall attachments 12 that attach to a shower wall, the front side 10*b* of the rectangular frame 10 defines an inner left side vertical channel 10*c* and an inner right side vertical channel 10*d*, a holder 14 is attached to the rectangular frame 10 at a top inner central position 10*e* of the rectangular frame 10. A rectangular compartment 20 that has at least one left retractable guide pin 20*a* and at least one right retractable guide pin 20*b*, the retractable guide pins 20*a*-20*b* are inserted within the vertical channels 10*c*-10*d* of the rectangular frame 10, a top central aperture 22 is defined on the rectangular compartment 20, and a cover 24 that is removably attached to the rectangular compartment 20, the cover 24 defines a plurality of apertures (not shown in figures for they are covered by the scrubbers of the present invention). A liquid soap holder 30 that is attached to the rectangular compartment 20. A plurality of scrubber sprockets 40 that are attached to the rectangular compartment 20, each scrubber sprocket 40 has a spindle 42. A first servomotor 50 that has a first sprocket 52 and a belt 54, the belt 54 operatively connects the first sprocket 52 to the scrubber sprockets 40. A plurality of electrical soap dispensers 60 and a plurality of soap dispensing hoses 62, each soap dispensing hose 62 connects to each electrical soap dispenser 60 and to the liquid soap holder 30. A second servomotor 70 that has a second sprocket 72 and a lift belt 74, the lift belt 74 is attached to the second sprocket 72 and to the holder 14. A controller 80 that operatively connects to the first servomotor 50, to the second servomotor 70 and to the electrical soap dispensers 60, the controller 80 is connected to a voice recognition device 82 and the controller 80 is programmed to receive at least one instruction from the voice recognition device 82 and to send at least one instruction to the first servomotor 50, to the second servomotor 70 or to the electrical soap dispensers 60. A power source 90 or battery 90 that is connected to the controller 80, the first servomotor 50, the second servomotor 70, the voice recognition device 82 and to the plurality of electrical soap dispensers 60. A plurality of scrubbers 92, each scrubber 92 attaches to the spindle 42 of the scrubber sprockets 40 when the cover 24 covers the rectangular compartment 20. And, an accordion cover 94 that attaches to the rectangular frame 10 and to the rectangular compartment 20 so that an inner section of the rectangular frame 10*h* that covers the holder 14 and the lift belt 74 is covered.

In an embodiment of the present invention, the controller 80 connects to an RF device.

The power source 90 or battery 90 of the present invention may be rechargeable.

In some embodiments of the present invention, the controller 80 is wired to the first servomotor 50 and to the second servomotor 70. In other embodiments, the connection of the controller 80 to the servomotors 50 and 70 is wireless. The controller 80 can be wired to the electrical soap dispensers 60 or it can be connected wirelessly to the electrical soap dispensers 60. In some embodiments, the controller shall have an integral speaker 96.

An advantage of the present invention is that it provides a voice-controlled shower back scrubber that is manipulated by a user to be at certain positions of a shower wall so that it corresponds to an exact location of the user's back.

Another advantage of the present invention is that it provides a shower back scrubber that allows a user to simply stand in one position while having his back scrubbed.

Yet another advantage of the present invention is that it provides a user with a shower back scrubber that prevents accidents from occurring while showering.

While the inventor's above description contains many specificities, these should not be construed as limitations on the scope, but rather as an exemplification of several preferred embodiments thereof. Many other variations are possible. Accordingly, the scope should be determined not by the embodiments illustrated, but by the appended claims and their legal equivalents.

What is claimed is:

1. A voice-controlled shower back scrubber, the back scrubber comprises:

a rectangular frame that has a rear and a front side, the rear side has at least two wall attachments that attach to a shower wall, the front side of the rectangular frame defines an inner left side vertical channel and an inner right side vertical channel, a holder is attached to the rectangular frame at a top inner central position of the rectangular frame;

a rectangular compartment that has at least one left retractable guide pin and at least one right retractable guide pin, the retractable guide pins are inserted within the vertical channels of the rectangular frame, a top central aperture is defined on the rectangular compartment, and a cover that is removably attached to the rectangular compartment, the cover defines a plurality of apertures;

a liquid soap holder that is attached to the rectangular compartment;

a plurality of scrubber sprockets that are attached to the rectangular compartment, each scrubber sprocket has a spindle;

a first servomotor that has a first sprocket and a belt, the belt operatively connects the first sprocket to the scrubber sprockets;

a plurality of electrical soap dispensers and a plurality of soap dispensing hoses, each soap dispensing hose connects to each electrical soap dispenser and to the liquid soap holder;

a second servomotor that has a second sprocket and a lift belt, the lift belt is attached to the second sprocket and to the holder;

a controller that operatively connects to the first servomotor, to the second servomotor and to the plurality of electrical soap dispensers, the controller is connected to a voice recognition device and the controller is programmed to receive at least one instruction from the voice recognition device and to send at least one instruction to the first servomotor, to the second servomotor or to the plurality of electrical soap dispensers;

a power source or battery that is connected to the controller, the first servomotor, the second servomotor, the voice recognition device and to the plurality of electrical soap dispensers;

a plurality of scrubbers, each scrubber attaches to the spindle of the scrubber sprockets when the cover covers the rectangular compartment; and an accordion cover that attaches to the rectangular frame and to the rectangular compartment so that an inner section of the rectangular frame that covers the holder and the lift belt is covered.

2. The voice-controlled shower back scrubber of claim 1, wherein the controller connects to an RF device.

3. The voice-controlled shower back scrubber of claim 1, wherein the power source or battery is rechargeable.

4. The voice-controlled shower back scrubber of claim 1, wherein the controller is wired to the first servomotor, to the second servomotor and to the plurality of electrical soap dispensers.

5. The voice-controlled shower back scrubber of claim 4, wherein the controller has an integral speaker.

* * * * *